United States Patent [19]

Hemperly

[11] 4,408,894

[45] Oct. 11, 1983

[54] MULTIPLE SELECTABLE TIMER

[76] Inventor: Richard E. Hemperly, 2544 Unicornio St., Carlsbad, Calif. 92008

[21] Appl. No.: 366,830

[22] Filed: Apr. 9, 1982

[51] Int. Cl.[3] ..... G04F 1/04

[52] U.S. Cl. ..... 368/93; 368/95

[58] Field of Search ..... 368/93–95

[56] References Cited

U.S. PATENT DOCUMENTS

| | | | |
|---|---|---|---|
| 2,199,645 | 5/1940 | McGehee | 368/93 X |
| 2,540,502 | 2/1951 | Aschbacher | 368/93 |
| 3,103,099 | 9/1963 | Hanks | 368/93 |
| 3,505,873 | 4/1970 | Cornelison et al. | 368/93 X |

FOREIGN PATENT DOCUMENTS

| | | | |
|---|---|---|---|
| 217583 | 1/1910 | Fed. Rep. of Germany | 368/95 |
| 479075 | 1/1938 | United Kingdom | 368/93 |

*Primary Examiner*—Ulysses Weldon

*Attorney, Agent, or Firm*—Brown & Martin

[57] ABSTRACT

A multiple selectable timer of the flowing medium type includes a housing including a medium reservoir and a catch chamber with a timing orifice for controlling the flow of the medium from the medium reservoir to the catch chamber and a metering passage for communicating between the catch chamber and the timing reservoir with the passage adapted to selectively meter predetermined portions of the flowing medium to define selected time intervals. The timer is arranged such that selective rotation of the housing in one direction loads the timing reservoir with selected intervals of timing medium and rotation of the housing in the opposite direction selectively removes predetermined portions of the timing medium.

10 Claims, 3 Drawing Figures

MULTIPLE SELECTABLE TIMER

BACKGROUND OF THE INVENTION

The present invention relates to timing devices and pertains particularly to a flowing medium type timing device.

Hour glasses and similar timing devices have been known for centuries. The conventional construction of an hour glass, however, limits its timing to a particular interval of time for each hour glass. Thus, any hour glass is designed to measure only a single duration of time and are not capable of selective intervals of time.

The time interval determined by an hour glass and similar such timing devices is determined by the quantity of the flowing medium and the restriction to flow as imposed by the structure of the timer. Thus, each hour glass is designed for a particular time interval.

It is desirable that flowing medium hour glass type timers be available which have selective durations of time.

SUMMARY AND OBJECTS OF THE INVENTION

It is therefore the primary object of the present invention to provide an improved timer device.

In accordance with the primary aspect of the present invention a selective interval is provided with a flowing medium and restriction means for restricting the flow of the medium between chambers with selective means for selecting predetermined quantities of flowing medium representing selective and individual time intervals.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
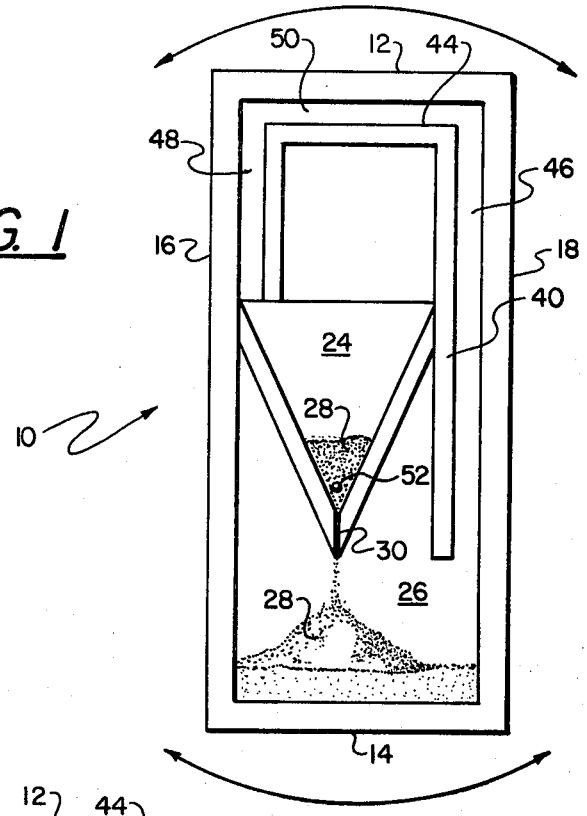
FIG. 1 is a side elevation view of a preferred embodiment of the invention.
Figure 2:
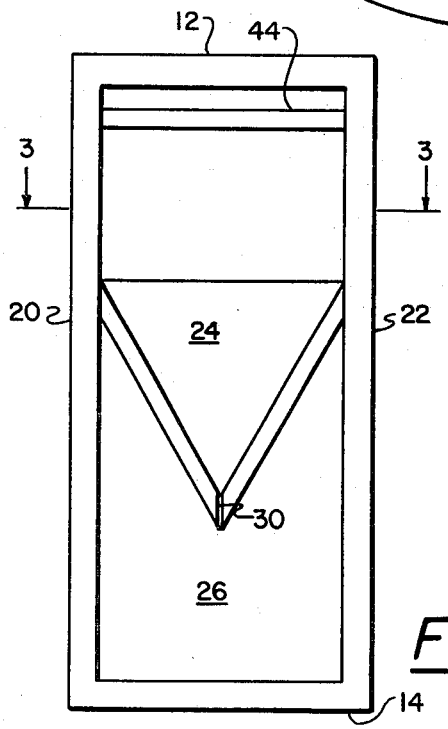
FIG. 2 is a front elevation view in section of the embodiment of FIG. 1.
Figure 3:
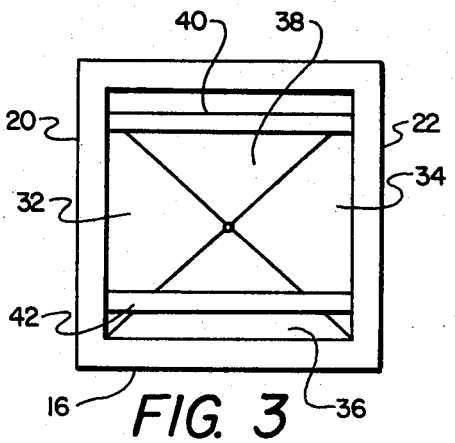
FIG. 3 is a view taken generally on line 3—3 of FIG. 2.

Turning to the drawings, there is illustrated a timer in accordance with the invention designated generally by the numeral 10 and comprising a housing of a generally box-like configuration having a generally square top 12, a similarly square bottom 14 with generally rectangular front and back panels 16 and 18. A pair of opposed side panels 20 and 22 have a generally rectangular configuration substantially identical to the front and back panels. The housing is preferably constructed, at least in part, from a transparent material.

The interior of the housing is separated by means of a plurality of wall panels into a timing reservoir 24 and a catch or receiving chamber 26. These are designed to respectively hold and catch a flowing medium 28, such as a granular medium; i.e., sand, miniature glass beads, or the like. The device can also utilize other flowing mediums, such as a viscous liquid or the like.

A metering orifice 30 is formed in the wall structure, or more particularly at the apex of the wall structure separating the chamber or reservoir 24 from the chamber 26, and is selected or adjusted in relation to quantities of the flowing medium to precisely meter predetermined quantities of the flowing medium per unit of time. Thus, selected quantities of the medium determine a time interval.

The interior of the housing is divided by wall means comprising a pyramid structure which forms the reservoir 24 which pyramid structure is constructed of a plurality of triangular panels 32 and 34 secured at their bases to the side walls or panels 20 and 22 and triangular panels 36 and 38 which are connected at their bases respectively to the front panel 16 and to a partition panel 40. The partition panel 40 together with a corresponding partition panel 42 spaced from the front panel in conjunction with a top panel 44 form a metering passageway. This passageway has a generally U-shaped configuration comprising, as best seen in FIG. 1, a pair of vertical legs 46 and 48 and a horizontal leg 50. A weighted sphere, such as a lead shot 52, too large to pass through orifice 30, may be placed in chamber 24 to serve as an indicator. This shot becomes visible when it drops with medium 28 to the bottom of reservoir 24.

This timing device enables a selected number of time intervals from 1 up to the maximum number provided for by the particular construction. By way of example, the orifice 30 is constructed to permit the passage of a given quantity or total charge of the timer therethrough in a predetermined period of time such as 10 minutes or the like. The passage 46, 44 and 48 communicating between the chamber 26 and reservoir 24 permits the loading of a predetermined minimum charge such as 1 minute quantity of the flowable medium with each loading of the reservoir. The minimum charge is loaded with each rotation of the entire timing unit in a clockwise direction as viewed in FIG. 1.

The restricted passageway 46 is such that normal rotation of the device in a clockwise direction, as viewed in FIG. 1 permits a quantity of the flowable medium 28 equivalent to one unit of time, such as a minute, for example, to pass along the passageway 46, 44 and 48 into the reservoir 24. As will be appreciated, the medium will flow down the passageway 46 across the passageway 44 as the device is continually rotated and down the passage 48 into reservoir 24. Thus, for a given unit as above example, ten rotations is required to completely load the device. Once the device is loaded, it can be simply rotated to the inverted position such that all of the flowable medium is contained within the box-like structure formed by the walls 40, 42 and 44. The wall 40 extends downward into chamber 26 to help control flow of medium in the passage 46, 48, 50, particularly when unloading a quantity of the medium. Upon inverting the device to the upright position, as shown in FIG. 1, the time interval is started. Upon the passage of the 10 minute interval, the last drop of the medium flows from the reservoir 24.

Once the device is loaded, if a time interval less than the maximum is desired, it can be selected simply by rotation of the unit in a counter clockwise direction one full rotation for each interval of 1 minute to be deducted from the full 10 minute time. This is accomplished by the passage of the flowable medium down passage 48 across passage 44 and out passage 46 into the chamber 26. Thus, for example, once the unit has been loaded for the full 10 minute duration, a 7 minute time interval can be selected simply by rotating the device in a counter clockwise direction three times. This essentially subtracts 3 minutes from the timing device.

Thus, while I have illustrated and described my invention by means of specific embodiments, it is to be understood that numerous changes and modifications may be made therein without departing from the spirit and scope of the invention as defined in the appended claims.

I claim:

1. A timing device comprising:

a closed housing having a longitudinal axis, a measured quantity of flowing medium contained within said housing, first walls means in said housing separating the interior thereof into a timing reservoir, and a catch chamber displaced along said longitudinal axis from said timing reservoir, said first wall means includes means defining a timing orifice for communicating a quantity of said flowing medium within said timing reservoir to said catch chamber, and second wall means defining a generally U-shaped restricted metering passage having one leg extending parallel to said longitudinal axis along one side of said housing for communicating with said catch chamber and another leg extending parallel to said longitudinal axis along the other side of said housing for communicating with said timing reservir for controllably conveying a predetermined measured portion of said measured quantity of flowing medium between said catch chamber and said timing reservoir upon complete rotation of said housing in a selected direction.

2. The timing device of claim 1 wherein said measured quantity of said flowing medium is a quantity requiring multiple units of time to flow from said timing reservoir via said timing orifice to said catch chamber, and said predetermined measured portion is a quantity representing one unit of time.

3. The timing device of claim 2 wherein said housing has a generally box-like configuration, and said timing reservoir has a generally pyramid configuration with said timing orifice at the apex thereof.

4. The timing device of claim 3 wherein said metering passage is formed of three connected legs, each leg extending at a right angle to each adjacent leg.

5. The timing device of claim 4 wherein said metering passage is generally U-shaped in side elevation.

6. The timing device of claim 5 wherein said housing is of a box-like configuration having a generally square configuration in plan view and a generally rectangular configuration in elevation.

7. The timing device of claim 2 wherein said metering passage is in open communication in both directions between said catch chamber and said timing reservoir for selected conveying of said predetermined measured portion in either direction between said catch chamber and said catch reservoir upon a selected one of alternate directions of rotation of said housing for selectively adding to or subtracting from the quantity of medium within said timing reservoir.

8. The timing device of claim 4 including a baffle within said housing for extending one of said legs.

9. The timing device of claim 8 wherein said baffle extends into said catch chamber.

10. A timing apparatus comprising:

a closed housing having a generally box-like configuration defined by a plurality of generally rectangular side walls and generally square top and bottom walls, a measured quantity of a flowing medium within said housing, pyramid-shaped walls disposed in said housing for separating the interior thereof into a timing reservoir and a catch chamber, said pyramid-shaped walls including means defining a timing orifice at the apex thereof for communicating a quantity of said flowing medium within said timing reservoir to said catch chamber at a controlled rate, and a plurality of partition walls disposed in said housing and spaced from said side walls and said top wall for defining a generally U-shaped restricted metering passage having one leg extending along one side wall and another leg extending along the opposite one of said side walls for communicating between said timing reservoir and said catch chamber for selected conveying of a predetermined measured portion of said flowing medium that is a fraction of said measured quantity of said flowing medium in either direction between said catch chamber and said timing reservoir upon a selected one of alternate directions of rotation of said housing for selectively adding to or subtracting from the quantity of flowing medium within said timing reservoir.

* * * * *